US007354308B2

(12) United States Patent
Iwahori

(10) Patent No.: US 7,354,308 B2
(45) Date of Patent: Apr. 8, 2008

(54) WATERPROOF CONNECTOR FOR FLAT CABLE

(75) Inventor: Yoshihiro Iwahori, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/498,055

(22) Filed: Aug. 3, 2006

(65) Prior Publication Data

US 2007/0037436 A1 Feb. 15, 2007

(30) Foreign Application Priority Data

Aug. 3, 2005 (JP) ..... 2005-225598
Aug. 3, 2005 (JP) ..... 2005-225599

(51) Int. Cl.
*H01R 13/40* (2006.01)

(52) U.S. Cl. ..... 439/587; 439/274

(58) Field of Classification Search ..... 439/274, 439/275, 279, 587, 588, 456–459
See application file for complete search history.

(56) References Cited

U.S. PATENT DOCUMENTS 6,302,734 B1 * 10/2001 Ichio et al. ..... 439/587
6,364,692 B1 * 4/2002 Okayasu et al. ..... 439/426
6,443,765 B2 * 9/2002 Ichio et al. ..... 439/587

FOREIGN PATENT DOCUMENTS

JP 6-5327 A 1/1994

* cited by examiner

*Primary Examiner*—Tho D. Ta
*Assistant Examiner*—Travis Chambers
(74) *Attorney, Agent, or Firm*—Sughrue Mion, PLLC

(57) ABSTRACT

A waterproof connector for a flat cable 10 includes a connecting housing 13 into which the terminal portions of two FFCs 11 can be guided through a guide hole 24 formed in the base end portion thereof and also which can store therein two or more terminals 12 connected to the terminal portions of the FFCs 11, a seal member 14 interposed between the FFCs 11 and the peripheral wall of the connector housing 13 for defining the guide hole 24, a rear cover 15 not only including two insertion holes 27 into which the FFCs 11 extended from the guide hole 24 of the connector housing 13 can be inserted but also mountable onto the base end portion of the connector housing 13 while inserting the FFCs 11 into the insertion holes 27, and a fixing plate 16 to be mounted onto the rear cover 15 in such a manner that the FFCs 11 inserted into the insertion holes of the rear cover 15 are held by and between the rear cover 15 and the fixing plate 16.

4 Claims, 10 Drawing Sheets

WATERPROOF CONNECTOR FOR FLAT CABLE

BACKGROUND OF THE INVENTION

1. Field of the Invention

The present invention relates to a waterproof connector for a flat cable which can be mounted on the terminal portion of a flexible flat cable such as an FFC (Flexible Flat Cable) and a ribbon line.

2. Description of the Related Art

As an example of a conventional waterproof connector for a flat cable, there is known a connector shown in FIG. 7 (see Japanese Patent Publication Hei 6-5327, for example).

In FIG. 7, there are shown a male side connector and a female side connector of a waterproof connector for a flat cable. The terminal portion of a flat cable 1*a* with a male terminal 2*a* connected thereto and the terminal portion of a flat cable 1*b* with a female terminal 2*b* connected thereto are respectively stored within a male connector housing 5 and a female connector housing 6.

On the flat cables 1*a*, 1*b*, there are provided resin formed portions 3*a*, 3*b* which are respectively formed by burying the longitudinal direction partial portions of the respective cables. With the resin formed portions 3*a*, 3*b*, there are fitted ring-shaped rubber plugs 4*a*, 4*b*, respectively.

On each of the outer peripheral surfaces of the rubber plugs 4*a*, 4*b*, there are arranged two ringshaped lips. The lips of the rubber plugs 4*a*, 4*b* are closely contacted with the inner peripheral wall surface of the cable guide portion of the male connector housing 5 and the inner peripheral wall surface of the cable guide portion of the female connector housing 6 respectively, whereby the cable guide portions can be surely made waterproof.

However, in the above-mentioned conventional waterproof connector for a flat cable, for example, the flat cable 1*a* (by the way, this description applies similarly to the flat cable 1*b* as well) is only supported by the peripheral wall of the cable guide portion of the male connector housing 5 through the resin formed portion 3*a* and rubber plug 4*a*.

For this reason, when en external force such as a tensile force is applied to the flat cable 1*a*, the flat cable 1*a* is easily displaced. Normally, the male terminal 2*a* is secured within the male connector housing 5 and, therefore, the displacement of the flat cable 1*a* applies a load to the connecting portion between the flat cable 1*a* and male terminal, which can raise a fear that the electrical connection of the connecting portion can be disrupted.

Further, when an external force is applied in a direction intersecting with the axial direction of the ring-shaped rubber plug 4*a* through the flat cable 1*a*, the rubber plug 4*a* is deformed to thereby produce a clearance between the rubber plug 4*a* and the inner wall surface of the cable guide portion of the male connector housing 5, which raises a fear that the waterproof condition of the cable guide portion can be worsened.

In the above-mentioned conventional waterproof connector for a flat cable, the resin of the resin formed portions 3*a*, 3*b* is charged into the uneven surfaces of the flat cables 1*a*, 1*b* to thereby prevent the formation of clearances between the resin formed portions 3*a*, 3*b* and flat cables 1*a*, 1*b*. Such resin formed portions 3*a*, 3*b* can be formed, for example, in such a manner that the flat cables 1*a*, 1*b* are held within a mold and are then insert molded. However, the productivity thereof is not high.

In view of this, there is proposed a structure in which lips similar to the lips 7*a*, 7*b* to be closely contacted with the inner periphery wall surfaces of the cable guide portions of the connector housings 5, 6 are provided on the inner peripheral surfaces of the rubber plugs 4*a*, 4*b* as well, the resin formed portions 3*a*, 3*b* are removed, and spaces between the rubber plugs 4*a*, 4*b* and flat cables 1*a*, 1*b* are kept waterproof by these lips. And, generally, it is believed that the more the number of lips is, the higher the waterproof condition is.

However, for example, as in the rubber plugs 4*a*, 4*b*, when two lips are formed on the inner peripheral surface of a ring-shaped seal member to be formed by injection molding, there is formed a constricted portion in a mold for injection molding. And, when the two lips are formed so as to be closely contacted with the outer peripheral surface of a flat cable having a small thickness, there is a fear that the strength of the constricted portion of the mold can be lowered.

That is, as shown in FIG. 6, in a mold 8, there are formed two ring-shaped cavities 9 into which molten injection molding material is filled to provide two ring-shaped lips. In the portions of the mold that are surrounded by the respective cavities 9, there are produced constricted portions; and, the mold 8 is divided into a set of mold pieces 8*a*, 8*b* in a plane passing through the centers of the two ring-shaped cavities 9. Therefore, there are produced constricted portions in both pieces 8*a*, 8*b* as well. Here, since the thickness of the flat cable is small, the opposing clearance between the cavities 9 is small, so that the thickness W of the constricted portion is small, which raises a fear that the strength of the constricted portions of the two mold pieces can be lowered. And, there is a feat that the lowered strength of the mold pieces constituting the mold can lower the productivity of the seal members and thus can lower the productivity of the connector.

SUMMARY OF THE INVENTION

The present invention is made in view of the above-mentioned circumstances of the prior art. Thus, it is an object of the invention to provide a waterproof connector for a flat cable which not only can provide excellent reliability of the electrical connection between the flat cable and a terminal but also can provide an excellent waterproof condition between them.

Also, the present invention is made in view of the above circumstances of the prior art. And thus, it is an object of the invention to provide a waterproof connector for a flat cable which is improved in productivity and waterproof performance.

The above-mentioned object can be attained by a waterproof connector for a flat cable as set forth in the following articles (1)-(8).

(1) A waterproof connector for a flat cable comprises: a connector housing for guiding therein the terminal portion of the flat cable through a guide hole formed in the base end portion thereof and for storing therein a terminal connected to the terminal portion of the flat. cable; a seal member interposed between the flat cable and the peripheral wall of the connector housing for defining the guide hole; a rear cover including an insertion hole for insertion of the flat cable extended out from the guide hole of the connector housing and mountable onto the base end portion of the connector housing with the flat cable inserted into the insertion hole; and, a fixing plate mountable onto the rear cover so as to hold the flat cable inserted into the insertion hole of the rear cover by and between the rear cover and itself.

(2) A waterproof connector for a flat cable as set forth in the above article (1), wherein, in the opening portion of the insertion hole of the rear cover, there is recessedly provided a step portion for spreading the opening of the insertion hole in the thickness direction of the flat cable to be inserted into the insertion hole, and the fixing plate includes a fitting portion fittable with the step portion with the flat cable interposed between the step portion and itself.

(3) A waterproof connector for a flat cable as set forth in the above article (2), wherein, in the step portion of the insertion hole of the rear cover, there is recessedly formed a transverse groove extending in the opposite direction to the extending direction of the flat cable extended from the insertion hole, and, in the fitting portion of the fixing plate, there is provided a projecting portion which can be fitted with the transverse groove while the flat cable is interposed between a wall surface defining the transverse groove and itself.

(4) A waterproof connector for a flat cable as set forth in the above article (1), wherein the rear cover includes a vertical groove extending from the middle portion of the insertion hole in the thickness direction of the flat cable to be inserted into the insertion hole, and a communication hole extending in the width direction of the flat cable for allowing the insertion hole and the vertical groove to communicate with the outside, and also wherein the fixing plate an insertion piece fittable with the vertical groove with the flat cable interposed between a wall surface defining the vertical groove and itself.

According to a waterproof connector as set forth in the above article (1), the flat cable, in the longitudinal direction thereof, is held by and between the rear cover and fixing plate with the terminal at a position in front of the seal member. Thanks to this, even when an external force such as a tensile force is applied to the flat cable, the force is cut off in the portion of the flat cable that is held by and between the rear cover and fixing plate and is thereby prevented from being transmitted to the connecting portion to the terminal and seal member. This not only can secure the reliability of the electrical connection between the flat cable and terminal but also can provide an excellent waterproof condition between them. And, since the flat cable is inserted into the insertion hole of the rear cover and is thereby positioned with respect to the rear cover, when the fixing plate is mounted onto the rear cover to thereby hold the flat cable, the flat cable is prevented from shaking and thus the fixing plate can be mounted onto the rear cover easily.

According to a waterproof connector as set forth in the above article (2), the flat cable is bent substantially in a crank-like manner by the step portion provided in the opening portion of the insertion hole of the rear cover and the fitting portion of the fixing plate, and the thus crank-shaped portion of the flat cable is in part turned in a direction intersecting with the extending direction of the flat cable extended from the insertion hole. This can positively cut off the external force applied to the flat cable.

According to a waterproof connector as set forth in the above article (3), the flat cable is further bent substantially in an S-shaped manner by the transverse groove formed in the step portion of the insertion hole of the rear cover and the projecting portion provided on the fitting portion of the fixing plate, and the thus S-shaped bent portion of the flat cable is turned in the opposite direction to the extending direction of the flat cable extended from the insertion hole. This can cut off the external force applied to the flat cable further positively.

According to a waterproof connector as set forth in the above article (4), the flat cable is bent substantially in a Q-shaped manner by the vertical groove of the rear cover and the insertion piece of the fixing plate, and the thus Q-shaped bent portion of the flat cable is in part turned in a direction intersecting with the extending direction of the flat cable extended from the insertion hole. This can cut off the external force applied to the flat cable.

Also, the flat cable bent substantially in a Q-shaped manner, when a tensile force is applied thereto, is restored , linearly while it is displaced in the longitudinal direction and thickness direction thereof, whereas the insertion piece of the fixing plate is inserted into the vertical groove of the rear cover in the width direction of the flat cable. Owing to this, even when the flat cable is pulled strongly, the fixing plate can be prevented from slipping off from the rear cover.

(5) A waterproof connector for a flat cable comprises: a connector housing for guiding therein the terminal portion of the flat cable through a guide hole formed in the base end portion thereof and for storing therein a terminal connected to the terminal portion of the flat cable; and seal means for providing a waterproof condition between the flat cable and the peripheral wall of the connector housing defining the guide hole thereof, wherein the seal means is composed of two or more seal members arranged in the longitudinal direction of the flat cable, and each seal member includes an insertion hole for insertion of the flat cable and a ring-shaped lip provided on the peripheral surface of the seal member defining the insertion hole thereof, the lip being closely contactable with the outer peripheral surface of the flat cable.

(6) A waterproof connector for a flat cable as set forth in the article (5) which further includes a rear cover to be mounted onto the base end portion of the connector housing so as to cover the guide hole of the connector housing, wherein, in the peripheral wall of the connector housing defining the guide hole thereof, there is formed a contact portion to be contacted with one end face of the seal means in the longitudinal direction of the flat cable and, in the rear cover, there is formed a pressure portion for pressing the other end face of the seal means in the longitudinal direction of the flat cable.

(7) A waterproof connector for a flat cable as set forth in the article (6), wherein the two or more seal members constituting the seal means are connected to each other, and the seal means is connected in the end face thereof to the pressure portion of the rear cover.

(8) A waterproof connector for a flat cable as set forth in the article (6), wherein the rear cover includes a peripheral wall for surrounding the outer periphery of the seal means with such a clearance between the outer peripheral surface of the seal means and itself as allows the storage of the base end portion of the connector housing.

According to a waterproof connector for a flat cable as set forth in the article (5), since, in each seal member, only one lip is formed in the insertion hole into which the flat cable can be inserted, there can be produced no constructed portion in the mold pieces constituting a mold for injection molding which is used when the seal members are formed by injection molding, with the result that the lowered strength of the mold pieces can be prevented. Thanks to this, the present waterproof connector for a flat cable is excellent in the productivity of the seal members and thus in the productivity of the connector itself.

And, by constructing the seal means in such a manner that the seal members are arranged in the longitudinal direction of the flat cable, the two or more lips can be closely contacted with the outer peripheral surface of the flat cable while they adjoin each other in the longitudinal direction of the flat cable. This can provide excellent waterproof performance between the seal means and flat cable.

According to a waterproof connector for a flat cable as set forth in the article (6), the seal means is held and compressed by the contact portion of the connector housing and the pressure portion of the rear cover in the longitudinal direction of the flat cable. As a result of this, the two or more seal members constituting the seal means are expanded in a direction intersecting at right angles with the longitudinal direction of the flat cable and can be more closely contacted with the outer peripheral surface of the flat cable and the peripheral wall surface of the connector housing defining the guide hole of the connector housing. This can enhance further the waterproof performance between the seal means and the flat cable and connector housing.

According to a waterproof connector for a flat cable as set forth in the article (7), since the two or more seal members are connected to each other into a unified body and the seal means composed of the thus unified two or more seal members is connected to the rear cover into a unified body, the rear cover and seal means can be assembled to the connector housing at a time. Therefore, the present connector is excellent in the productivity thereof.

Also, when the rear cover is removed, the seal means inserted into the guide hole of the connector housing can also be removed from the connector housing. The present seal means is excellent in the maintenance thereof.

According to a waterproof connector for a flat cable as set forth in the article (8), because the seal means is surrounded by the peripheral wall of the rear cover, there can be reduced a possibility that a foreign object can stick to the seal means before it is assembled to the connector housing and also the seal means can be prevented against damage. This makes it possible to use highly stickable material for the two or more seal members which constitute the seal means, thereby being able to enhance the close contact of the seal members with the flat cable and connector housing. Thus, the waterproof performance between the seal means and the flat cable and connector housing can be enhanced further.

According to the invention, there can be provided a waterproof connector for a flat cable which not only can provide the excellent reliability of the electrical connection between the flat cable and a terminal but also can provide an excellent waterproof condition between them.

According to the invention, there can be provided a waterproof connector for a flat cable which is excellent in productivity and waterproof performance.

DESCRIPTION OF THE PREFERRED EMBODIMENTS

Now, description will be given below in detail of preferred embodiments according to the invention with reference to the accompanying drawings.

Figure 1:
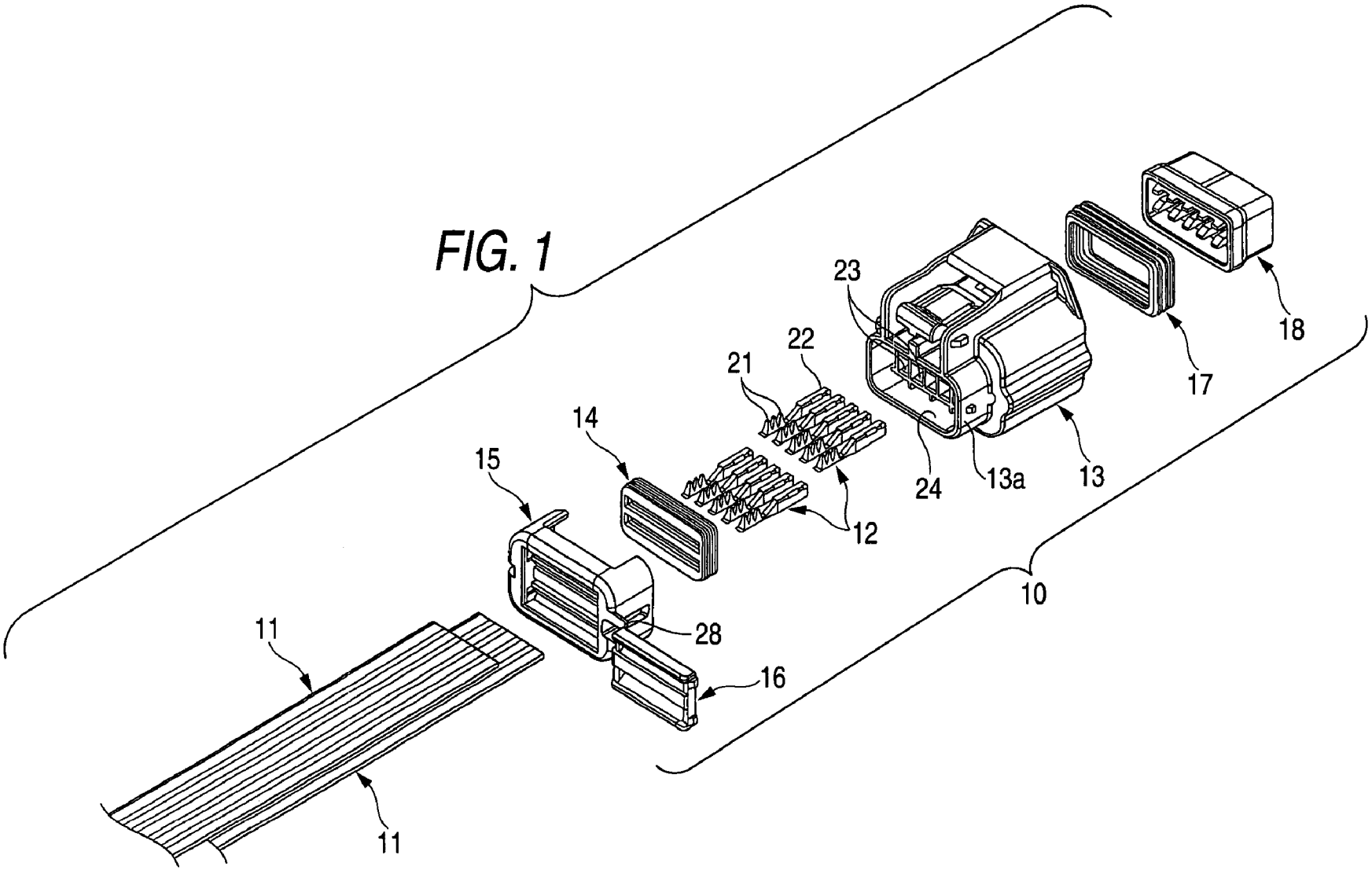
FIG. 1 is an exploded perspective view of a first embodiment of a waterproof connector for a flat cable according to the invention.
Figure 2:
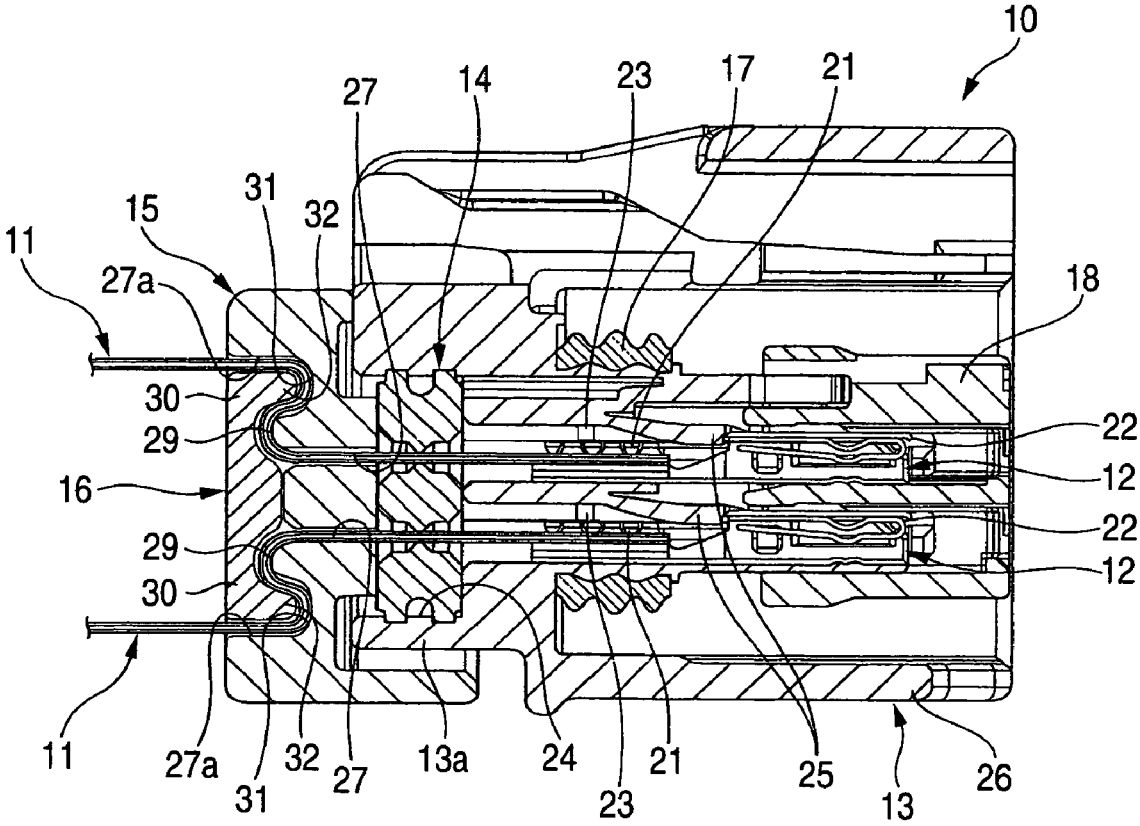
FIG. 2 is a section view of the waterproof connector for a flat cable shown in FIG. 1, showing its assembled state.
Figure 3:
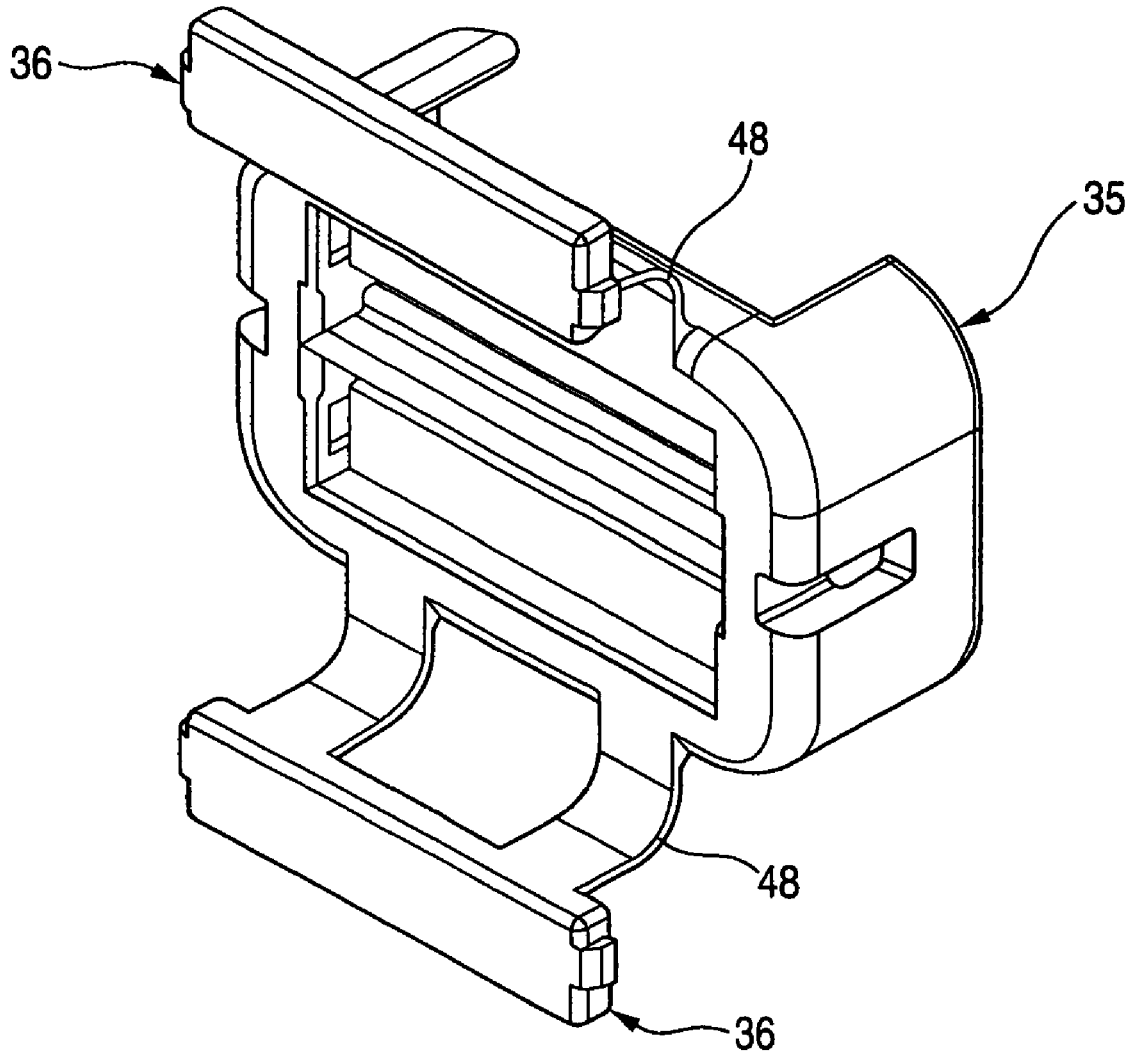
FIG. 3 is a perspective view of a rear cover and a fixing plate employed in a second embodiment of a waterproof connector for a flat cable according to the invention.
Figure 4:
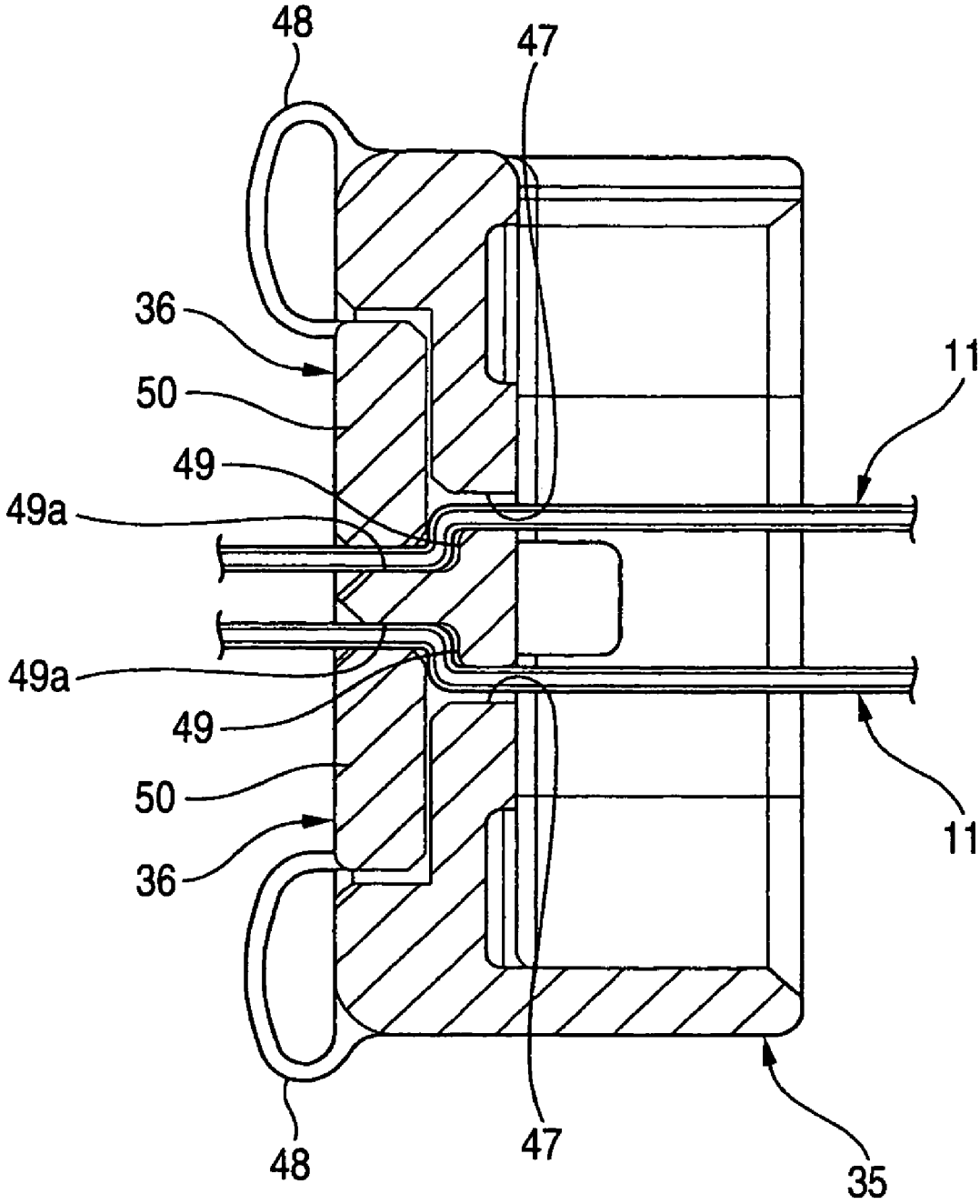
FIG. 4 is a section view, showing a state in which a flat cable is held by the rear cover and fixing plate shown in FIG. 3.
Figure 5:
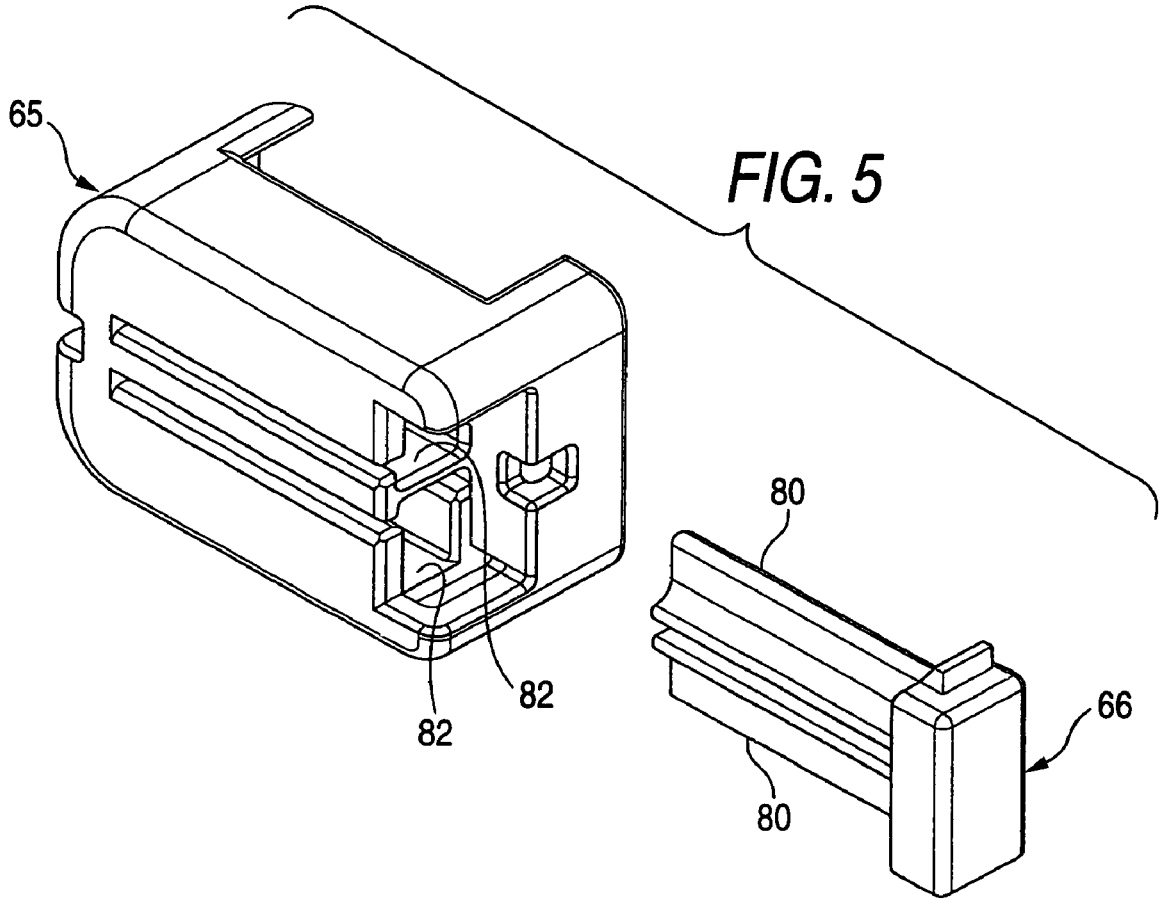
FIG. 5 is a perspective view of a rear cover and a fixing plate employed in a third embodiment of a waterproof connector for a flat cable according to the invention.
Figure 6:
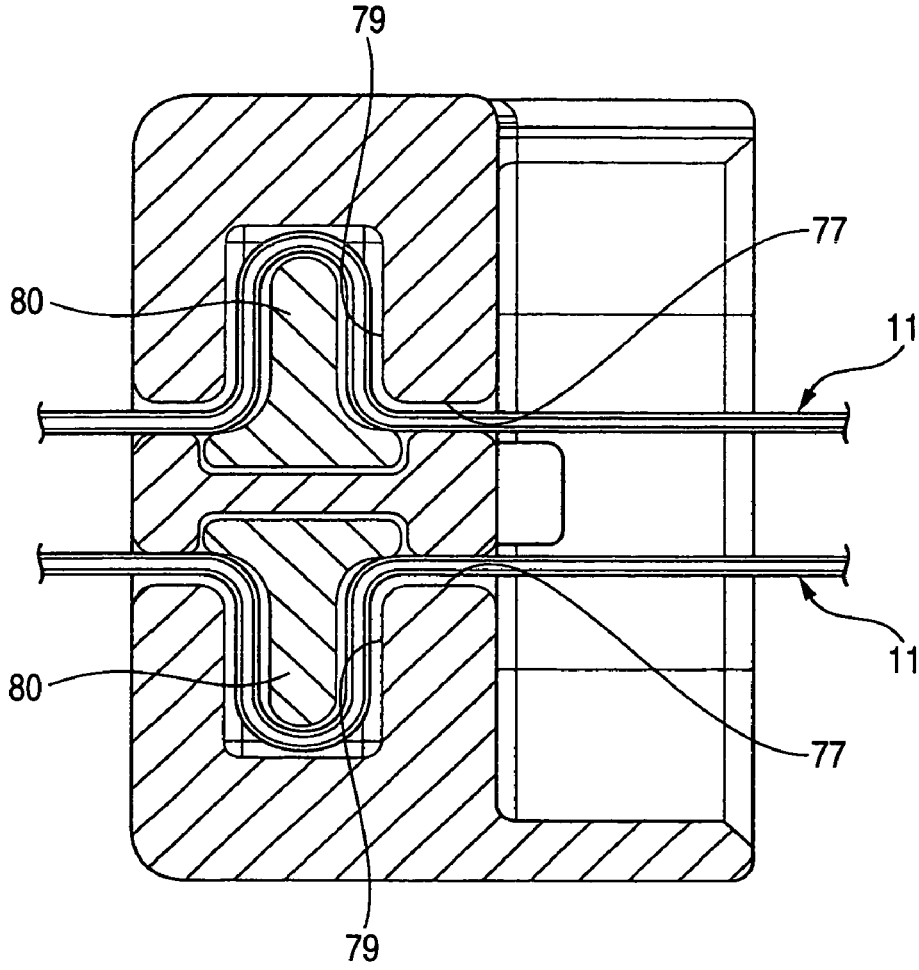
FIG. 6 is a section view, showing a state in which a flat cable is held by the rear cover and fixing plate shown in FIG. 5.
Figure 7:
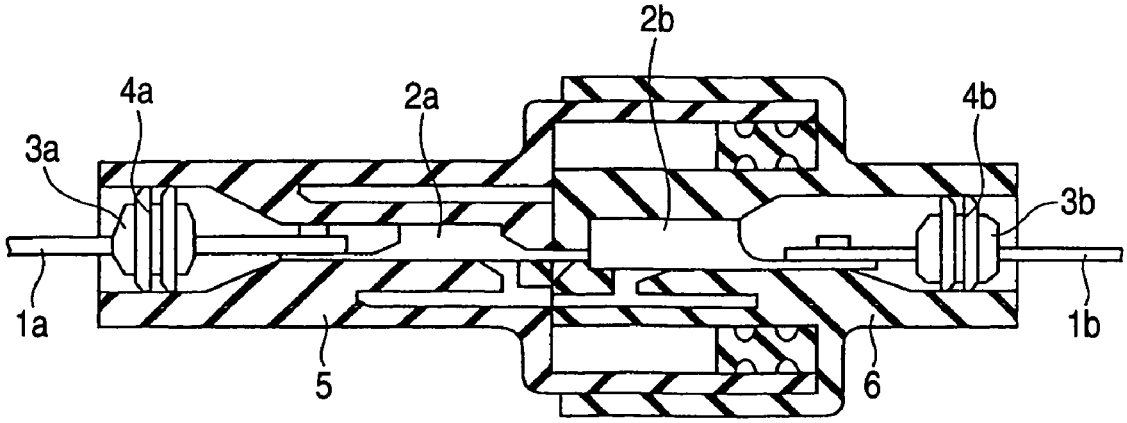
FIG. 7 is a section view of a conventional waterproof connector for a flat cable.

FIG. 1 is an exploded perspective view of a first embodiment of a waterproof connector for a flat cable according to the invention, FIG. 2 is a section view of a waterproof connector for a flat cable shown in FIG. 1, showing an assembled state thereof, FIG. 3 is a perspective view of a rear cover and a fixing plate respectively employed in a second embodiment of a waterproof connector for a flat cable according to the invention, FIG. 4 is a section view to show a state in which a flat cable is held by and between the rear cover and fixing plate shown in FIG. 3, FIG. 5 is a perspective view of a rear cover and a fixing plate respectively employed in a third embodiment of a waterproof connector for a flat cable according to the invention, and FIG. 6 is a section view to show a state in which a flat cable is held by and between the rear cover and fixing plate shown in FIG. 5.

First Embodiment

As shown in FIGS. 1 and 2, a waterproof connector for a flat cable (which is hereinafter referred to as a connector simply) 10 is mounted on the terminal portions of two FFCs 11 disposed parallel to each other while they are spaced apart from each other in the thickness direction thereof. The connector 10 includes two or more terminals 12 to be connected to the terminal portions of the FFCs 11, a connector housing 13 for storing the two or more terminals 12 therein, a seal member 14 for providing a waterproof condition between the FFCs 11 and connector housing 13, a rear cover 15 to be mounted on to the connector housing 13, and a fixing plate 16 to be mounted onto the rear cover 15.

To produce the FFC 11, for example, two or more long conductors made of rolled copper foil may be held parallel by and between base films at given intervals and may be then unified together. To the terminal portion of the FFC11, there are connected the two or more terminals 12 which are to be electrically connected to the respective conductors.

The terminal 12 includes, in the base end portion thereof, two or more blades 21 which penetrate through the FFC 11 in the thickness direction thereof, are electrically connected to the conductors of the FFC 11 and are cauklingly fixed to the FFC 11. Also, the terminal 12 further includes, in the leading end portion thereof, an electrically connecting portion 22 to be connected to a terminal which is provided in a partner connector (not shown).

The two or more terminals 12 connected to the terminal portion of the FFCs 11 are stored into the interior of the Connector housing 13. In the interior of the connector housing 13, there are formed two or more terminal storage rooms 23 which respectively store their associated terminals 12 therein. The two or more terminal rooms 23 are arranged in two stages so as to correspond to the FFCs 11 which are arranged in two stages.

In the base end portion 13*a* of the connector housing 13, there is formed a guide hole 24 which communicates with the base end sides of the two or more terminal rooms 23 from outside. The terminal portions of the two FFCs 11 are guided through the guide hole 24 into the connector housing 13, and the two or more terminals 12 respectively connected to the terminal portions of the FFCs 11 are respectively inserted and stored into the two or more terminal storage rooms 23. When the terminals 12 are stored into the terminal storage rooms 23, the base end portions of the electrically connecting portions 22 of the terminals 12 are secured by elastic securing pieces disposed in the interior of the terminal storage rooms 23, whereby the terminals 12 are prevented from coming off from the terminal storage rooms.

On the connector housing 13, there is provided a tubular-shaped hood portion 26 which surrounds the outer peripheries of the two or more terminal storage rooms 23 with a clearance between them , When the connector 10 and its partner connector are fitted with each other, the hood portion of the partner connector, which is provided similarly to the hood portion 26 of the connector housing 13, is inserted into between the hood portion 26 and two or more terminal rooms 23. A ring-shaped seal member 17 is fitted with and attached to the two or more terminal storage rooms 23. The seal member 17 is a member which can be closely contacted with the outer peripheral wall surfaces of the two or more terminal storage rooms 23 and the inner peripheral wall surface of the hood portion of the partner connector to thereby provide a waterproof condition between them.

Also, on the leading end portions of the two or more terminal storage rooms 23, there is mounted a front holder 18. A portion of the front holder 18 (the front holder front side projecting portion) is inserted into the flexural space of the elastic securing piece 25 to thereby secure the terminals 12 doubly.

In the seal member 14, there are formed penetration holes arranged in two stages, while each penetration hole is formed so as to have a section shape slightly larger than the section shape of the FFC 11. While the two FFCs 11 are respectively inserted through these penetration holes of the seal member 14, the seal member 14 is disposed within the guide hole 24 of the connector housing 13 and is interposed between the FFCs 11 and the peripheral wall of the connector housing 13 that defines the guide hole 24. On the outer peripheral surface of the seal member 14, there is provided a ring-shaped lip which projects outwardly; and, on the peripheral surface of the seal member 14 which defines the penetration holes thereof, there is provided a ring-shaped lip which projects inwardly. These lips are respectively closely contacted with the peripheral wall surface of the connector housing 13 defining the guide hole 24 thereof and the outer peripheral surfaces of the FFCs 11, thereby providing a waterproof condition between the FFCs 11 and connector housing 13.

In the rear cover 15, there are formed insertion holes 27 arranged in two stages, while each insertion hole 27 is formed so as to have a section shape slightly larger than the section shape of the FFC 11. While the two FFCs 11 extended from the guide hole 24 of the connector housing 13 are inserted into these insertion holes 27 respectively, the rear cover 15 is mounted on the base end portion of the connector housing 13 in such a manner that it covers the guide hole 24 of the connector housing 13. The FFCs 11, which have been inserted into the insertion holes 27 of the rear cover 15, are held in a state where their displacements are restricted in the thickness direction and in the width direction thereof within the insertion holes 27; that is, the FFCs 11 are positioned in this manner.

In the opening portion 27*a* of each insertion hole 27, there is recessedly formed a step portion 29 which is used to spread the opening of the insertion hole 27 in the thickness direction of the FFC 11; and, in the step portion 29, there is recessedly formed a transverse groove 31 which extends from the insertion hole 27 in the opposite direction to the extending direction of the FFC 11. The step portions 29 and transverse grooves 31, which are respectively formed in the opening portions of the insertion holes 27*a* arranged in two stages, are symmetric with respect to a virtual plane passing through the centers of the insertion holes 27 arranged in two stages.

The fixing plate 16 is connected through a hinge 28 to one outside surface of the rear cover 15 existing in the width direction of the FFC 11 and is thereby formed integral with the rear cover 15. And, the fixing plate 16 includes a set of fitting portions 30 which can be respectively fitted with their associated step portions 29 of the rear cover 15 with the FFCs 11 interposed between them; and, on the respective fitting portions 30, there are provided projecting portions 32 which can be fitted with their associated transverse grooves 31 while the FFCs 11 are interposed between the projecting portions 31 and wall surfaces which are formed on the corresponding step portions 29 and define the transverse grooves 31.

This fixing plate 16 is mounted on the rear cover 15 while the fitting portions 30 and projecting portions 32 of the fixing plate 16 are respectively fitted with their corresponding step portions 29 and transverse grooves 31 of the rear cover 15. The two FFCs 11 are set symmetric and are respectively bent substantially in a crank-shaped manner by the step portions 29 of the rear cover 15 and the fitting portions 30 of the fixing plate 16; a portion of each of the crank-shaped bent portions is turned in a direction substantially intersecting at right angles with the extending direction from the insertion hole 27 and is further bent substantially in an S-shaped manner by the transverse groove 31 of the rear cover 15 and the projecting portion 32 of the fixing plate 16; and, a portion of the S-shaped bent portion of the FFC is turned in the opposite direction to the extending direction of the FFC extended from the insertion hole 27 and is thereby bent held by and between the rear cover 15 and fixing plate 16.

As has been described above, according to the connector 10 of the present embodiment, the FFCs 11, in the longitudinal direction thereof, are held by and between the rear cover 15 and fixing plate 16 at a position in front of their connecting portions with the terminals 12 and seal member 14. Owing to this, even an external force such as a tensile force is applied to the FFCs 11, the external force is cut off in the portions of the FFCs 11 that are held by the rear cover 15 and fixing plate 16 and is thereby prevented from being transmitted to the connecting portions with the terminals and seal member 14. This not only can secure the reliability of the electrical connection between the FFCs 11 and terminals 12 but also allow the seal member 14 to provide a waterproof condition. And, when the FFCs 11 are respectively inserted into the insertion holes 27 of the rear cover 15, they are positioned by the rear cover 15. Therefore, when mounting the fixing plate 16 onto the rear cover 15 to hold the FFCs 11 by and between these two members, the FFCs 11 are prevented from shaking, so that the fixing plate 16 can be mounted easily.

Also, according to the connector 10 of the present embodiment, each of the FFCs 11 is bent substantially in a crank-shaped manner by the step portion 29 provided on the opening portion 27*a* of the insertion hole 27 of the rear cover 15 and the fitting portion 30 of the fixing plate 16; a portion of the thus crank-shaped portion is turned in a direction intersecting with the extending direction from the insertion hole 27 and is further bent substantially in an S-shaped manner by the transverse groove 31 formed in the step portion 29 of the insertion hole 27 of the rear cover 15 and the projecting portion 32 provided on the fitting portion 30 of the fixing plate 16; and, a portion of the thus S-shaped bent portion is turned in the opposite direction to the extending direction from the insertion hole 27. This can positively cut off an external force which is applied to the FFCs 11. In other words, the rear cover 15 and fixing plate 16 fulfill the function of a strain relief.

Also, in the connector 10 according to the present embodiment, there is employed a structure in which the fixing plate 16 is mounted onto the rear cover 15 from the side where the FFCs 11 are extended, and the FFCs 11 are held by and between these two members, in other words, a structure in which the flat cable is held by and between two members arranged side by side in the longitudinal direction of the flat cable. Here, in a hold structure for holding a flat cable by and between two members arranged so as to hold the flat cable between them, when two or more flat cables are disposed in two or more stages, that is, they are arranged parallel to each other while they are spaced apart from each other in the thickness direction thereof, the two members for holding the respective flat cables are piled up on top of each other in the thickness direction thereof, there is a fear that not only the mounting of the flat cables is difficult but also the size of the structure increases in the thickness direction of the flat cable. On the other hand, the hold structure for holding a flat cable by and between two members arranged parallel in the longitudinal direction of the flat cable is advantageous in that it can be easily applied to a case where flat cables are arranged in two or more stages and it can contribute toward reducing the size of a connector.

Second Embodiment

Next, description will be given below of a waterproof connector (which is hereinafter referred to as a connector simply) for a flat cable according to a second embodiment of the invention with reference to FIGS. 3 and 4. By the way, a connector according to the second embodiment is different from the above-mentioned connector 10 according to the first embodiment only in a rear cover and a fixing plate, but the other remaining components thereof are the same and thus the description thereof is omitted here.

As shown in FIGS. 3 and 4, a rear cover 35 according to the present embodiment includes two insertion holes 47 which are arranged in two stages and are formed to have a section shape slightly larger than the section shape of the FFC 11. The rear cover 35, while inserting two FFCs 11 extended from the guide holes 24 of the connector housing 13 into these insertion holes 47 respectively, is mounted onto the base end portion of the connector housing 13 so as to cover the guide holes 24 of the connector housing 13. The FFCs 1, which have been inserted into the insertion holes 47, are restricted in displacement within the insertion holes 47 in the thickness and width direction displacement thereof.

In the opening portion of each of the insertion holes 47, there is recessedly formed a step portion 49 which spreads the opening of the insertion hole 47 in the thickness direction of the FFC 11. The step portions 49, which are respectively formed in the opening portions of the insertion holes 47 arranged in two stages, are symmetric with respect to a virtual plane passing through the centers of the insertion holes 47 arranged in two stages.

And, the connector according to the present embodiment includes two fixing plates 36 which are connected through their associated hinges 48 to the two outside surfaces of the rear cover 35 existing in the thickness direction of the FFC 11. Each fixing plate 36 includes a fitting portion 50 which can be fitted with the step portion 49 with the FFC 11 interposed between the step portion 49 of its corresponding rear cover 35 and itself.

These two fixing plates 36 are mounted on the rear cover 35 with their fitting portions 50 respectively fitted with their corresponding step portions 49 of the rear cover 35. The two FFCs 11 are set symmetric and are respectively bent substantially in a crank-shaped manner by the step portions 49 of the rear cover 35 and the fitting portions 50 of the fixing plates 36; and, a portion of each of the crank-shaped bent portions is turned in a direction substantially intersecting at right angles with the extending direction from the insertion hole 47 and is further bent held by and between the rear cover 35 and fixing plate 36.

The waterproof connector for a flat cable according to the present embodiment can provide similar effects to the waterproof connector 10 for a flat cable according to the previously described first embodiment.

Third Embodiment

Next, description will be given below of a waterproof connector (which is hereinafter referred to as a connector simply) for a flat cable according to a third embodiment of the invention with reference to FIGS. 5 and 6. By the way, a connector according to the second embodiment is different from the above-mentioned connector 10 according to the first embodiment only in a rear cover and a fixing plate, but the other remaining components thereof are the same and thus the description thereof is omitted here.

As shown in FIGS. 5 and 6, a rear cover 65 according to the present embodiment includes two insertion holes 77 which are arranged in two stages and are formed to have a section shape slightly larger than the section shape of the FFC 11. The rear cover 65, while inserting two FFCs 11 extended from the guide holes 24 of the connector housing 13 into these insertion holes 77 respectively, is mounted onto the base end portion of the connector housing 13 so as to cover the guide holes 24 of the connector housing 13. The FFCs 11, which have been inserted into the insertion holes 77, are restricted in displacement within the insertion holes 77 in the thickness and width direction displacement thereof.

And, the rear cover 65 includes two vertical grooves 79 which extend from the middle portions of the respective insertion holes 77 in the thickness direction of the FFC 11 so as to part away from each other. These two vertical grooves 79 are symmetric with respect to a virtual plane passing through the centers of the insertion holes 77 arranged in two stages. The rear cover 65 further includes two communication holes 82 which extend in the width direction of the FFCs 11 and allow the vertical grooves 79 and the insertion holes 77 with the vertical grooves 79 connected thereto to communicate with the outside.

A fixing plate 66 according to the present embodiment includes two insertion pieces 80 which can be respectively inserted from their associated communication holes 82 into the vertical grooves 79 with the communication holes 82 connected thereto and can be fitted with the vertical grooves 79 with the FFCs 11 interposed between wall surfaces defining the vertical grooves 79 and themselves.

The fixing plate 66 is mounted on the rear cover 65 in such a manner that the insertion pieces 80 are inserted through the communication holes 82 of the corresponding rear cover 65 and are fitted with the vertical grooves 79 with the communication holes 82 connected thereto while the FFCs 11 are interposed between the insertion pieces 80 and vertical grooves 79. The two FFCs 11 are symmetric and they are respectively bent substantially in a Q-shaped manner by the vertical grooves 79 of the rear cover 65 and the insertion pieces 80 of the fixing plate 66, while a portion of each of the thus Q-shaped bent portions is turned in a direction substantially intersecting at right angles with the extending direction thereof from the insertion hole 77, whereby the two FFCs 11 are bent held by and between the rear cover 65 and fixing plate 66 respectively.

In the waterproof connector for a flat cable according to the present embodiment, the FFCs 11 are bent substantially in a Q-shaped manner by the vertical grooves 79 of the rear cover 65 and the insertion pieces 80 of the fixing plate 66, while the thus Q-shaped bent portions are in part turned in a direction intersecting with the extending direction thereof from the insertion holes 77. This can positively cut off a tensile force or an external force which is applied to the FFCs 11. That is, the rear cover 65 and fixing plate 66 fulfill the function of a strain relief. Also, the substantially Q-shaped bent FFCs 11, when a tensile force is applied thereto, are displaced in the longitudinal direction and width direction thereof and are restored into a linear shape, whereas the Insertion pieces 80 of the fixing plate 66 are inserted into the vertical grooves 79 of the rear cover 65 in the width direction of the FFCs 11. Therefore, even when the FFCs 11 are pulled strongly, the fixing plate 66 is prevented against removal from the rear cover 65. The other effects of the present embodiment are similar to those of the waterproof connector 10 for a flat cable according to the previously described first embodiment.

Further, in the waterproof connector for a flat cable according to the present embodiment, there is employed a structure in which the fixing plate 66 is mounted onto the rear cover 65 from the side thereof corresponding to the width direction of the FFCs 11 and the FFCs 11 are held by and between these two members. Such flat cable hold structure is easy to apply even when flat cables are arranged in multiple stages, which can advantageously contribute toward reducing the size of the connector.

Fourth Embodiment

Now, description will be given below in detail of a fourth embodiment of a waterproof connector for a flat cable according to the invention with reference to the accompanying drawings.

Figure 8:
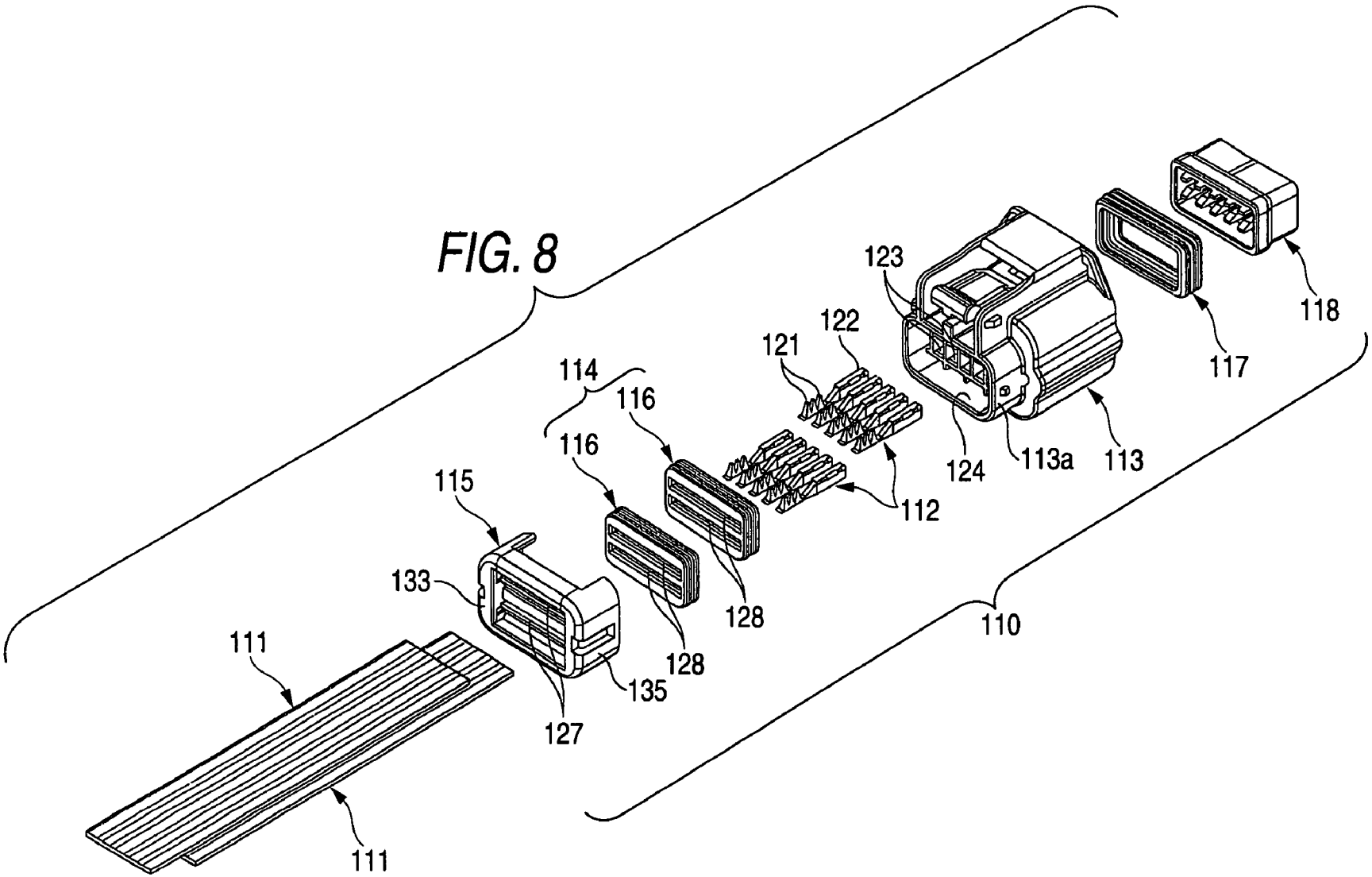
FIG. 8 is an exploded perspective view of an embodiment of a waterproof connector for a flat cable according to the invention.
Figure 9:
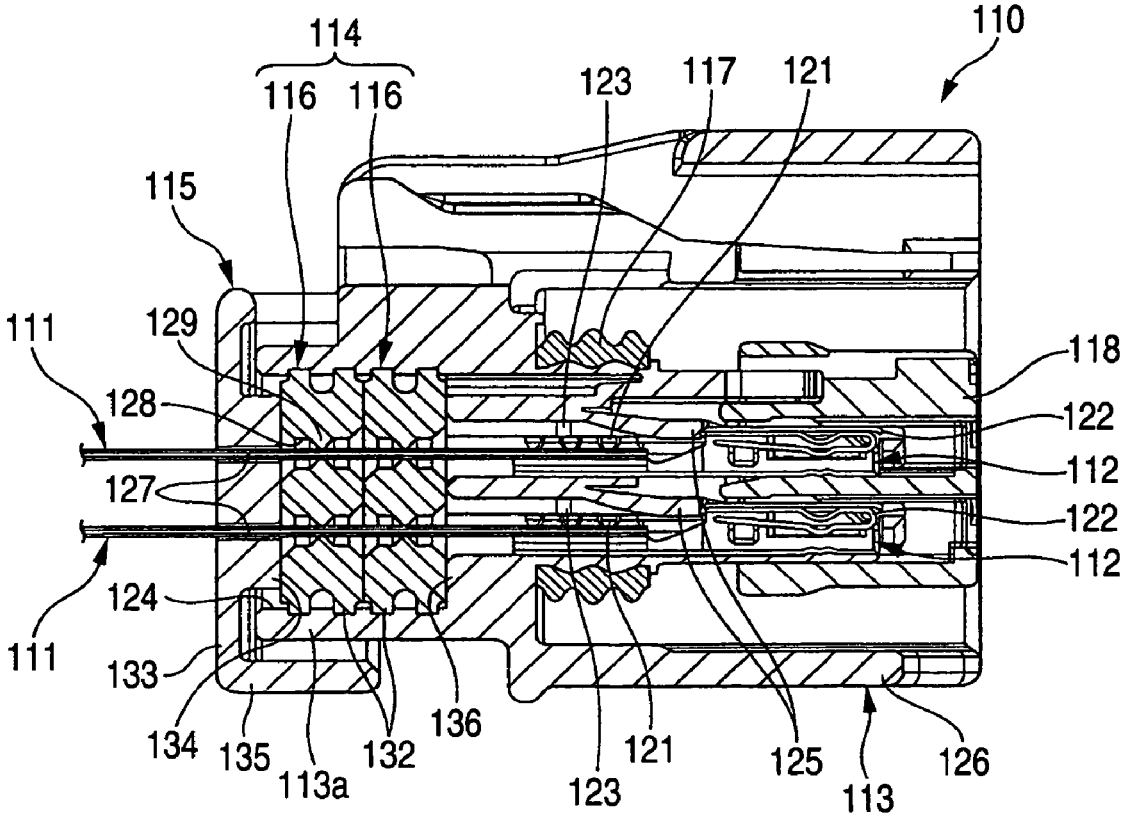
FIG. 9 is a section view of a waterproof connector for a flat cable , showing its assembled state.
Figure 10:
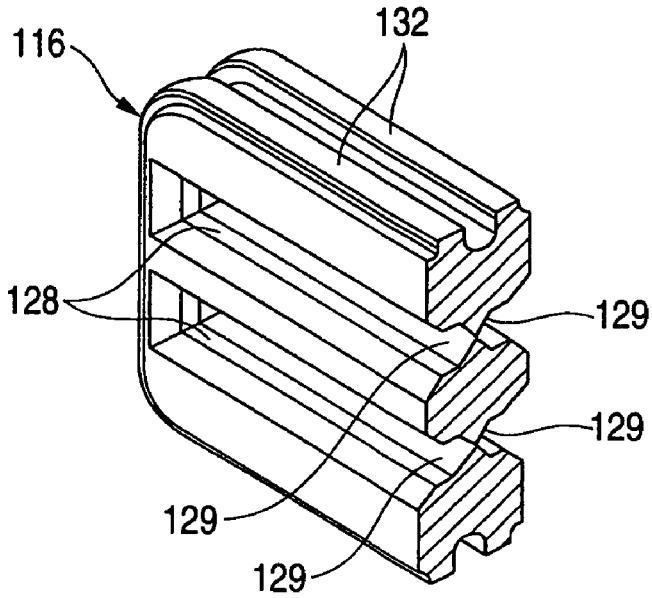
FIG. 10 is a partially broken perspective view of a seal member shown in FIG. 1.
Figure 11:
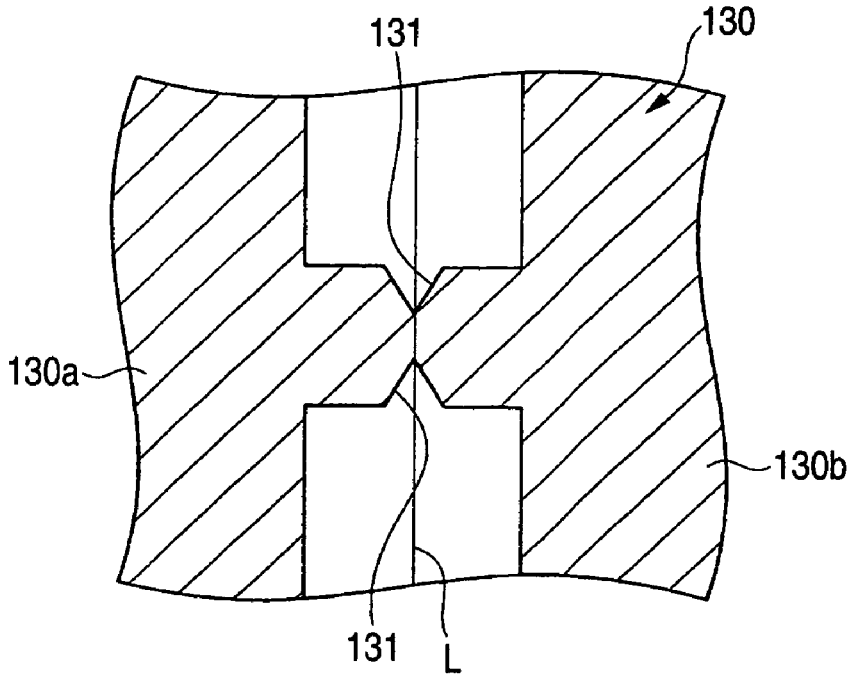
FIG. 11 is a section view of the main portions of a mold for injection molding used to mold the seal member shown in FIG. 3.
Figure 12:
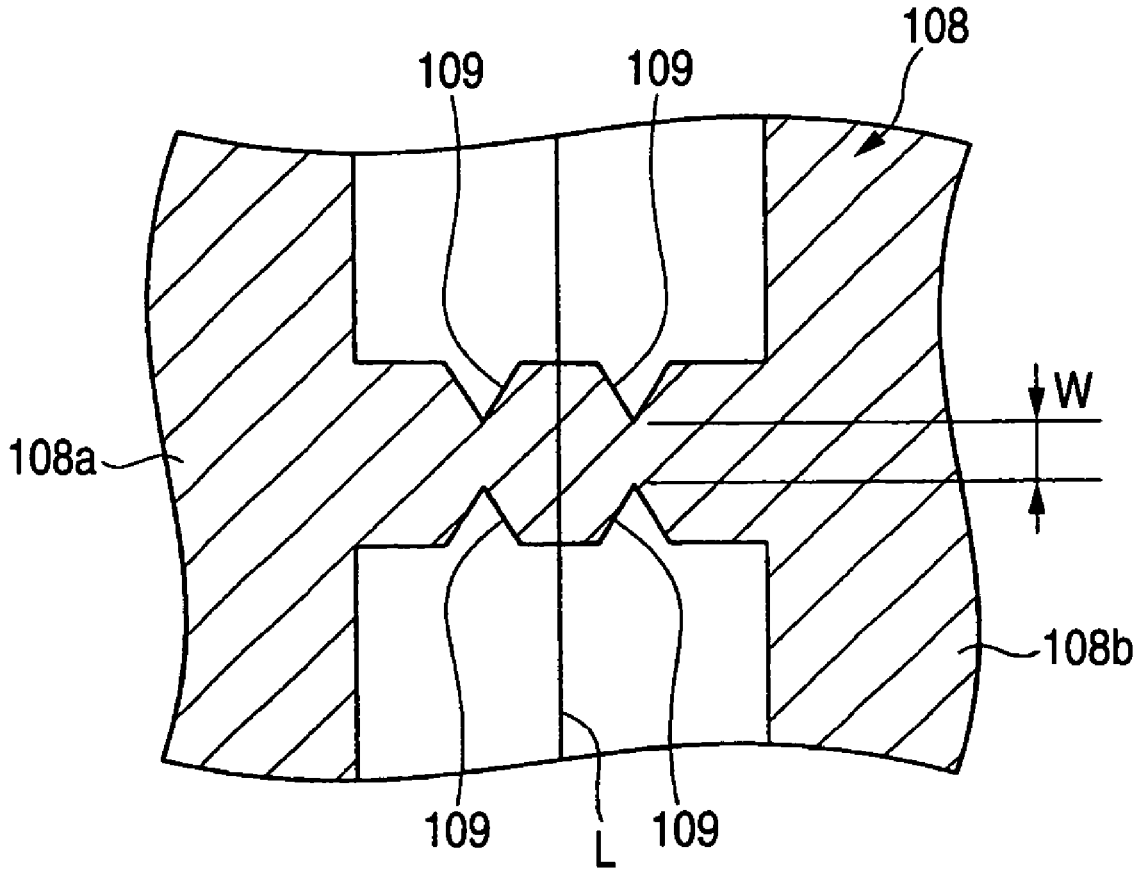
FIG. 12 is a section view of the main portions of an example of an injection molding mold for molding a ring-shaped seal member including two ring-shaped lips in the inner peripheral surface thereof

FIG. 8 is an exploded perspective view of an embodiment of a waterproof connector for a flat cable according to the invention, FIG. 9 is a section view of a waterproof connector for a flat cable, showing its assembled state, FIG. 10 is a partially broken perspective view of a seal member shown in FIG. 8, and FIG. 11 is a section view of the main portions of a mold for injection molding used to mold the seal member shown in FIG. 10.

As shown in FIGS. 8 and 9, a waterproof connector for a flat cable (which is hereinafter referred to as a connector simply) 110 according to the present embodiment is mounted on the terminal portions of two FFCs 111 which are arranged parallel to each other and are spaced from each other in the thickness direction thereof. The connector 110 includes two or more terminals 112 to be connected to the terminal portions of the FFCs 111, a connector housing 113 for storing the two or more terminals 112 therein, seal means 114 for providing a waterproof condition between the FFCs 111 and connector housing 113, and a rear cover 15 to be mounted onto the connector housing 113.

To produce the FFC 111, for example, two or more long conductors made of rolled copper foil may be held parallel between base films at given intervals, and the conductors and base films may be then connected together into a unified body. To the terminal portion of the FFC 111, there are connected two or more terminals 112 which can be electrically connected to their associated conductors.

Each terminal 112 includes, in the base end portion thereof, two or more blades 121 which not only penetrate through the FFC 111 in the thickness direction thereof and are electrically connected to the conductors provided in the interior of the FFC 111 but also are cauklingly fixed to the FFC 111. Also, the terminal 112 further includes, in the leading end portion thereof, an electrically connecting portion 122 to be connected to a terminal provided in a partner connector (not shown).

The two or more terminals 112, which have been connected to the terminal portion of the FFC 111, are stored into the interior of the connector housing 113. In the interior of the connector housing 113, there are formed two or more terminal storage rooms 123 respectively for storing their associated terminals 112 therein. The two or more terminal storage rooms 123 are arranged in two stages in correspondence to the FFCs 111 to be arranged in two stages.

In the base end portion 113*a* of the connector housing 113, there is formed a guide hole 124 which communicates with the base end sides of the two or more terminal storage rooms 123 from outside. The terminal portions of the two FFCs 111 are guided into the interior of the connector housing 113 through the guide hole 124, and the two or more terminals 112, which have been respectively connected to the terminal portions of these two FFCs 111, are inserted and stored into their associated terminal storage rooms 123 respectively. After the terminals 112 are stored into the terminal storage rooms 123, the base end portions of the electrically connecting portions 122 of the terminals 112 are secured by elastic securing pieces 125 which are provided in the interior of the terminal storage rooms 123, whereby the terminals 112 are prevented against removal from the terminal storage rooms 123.

Also, the connector housing 113 includes a tubular-shaped hood portion 126 which surrounds the outer peripheries of the two or more terminal storage rooms 123 with a clearance between them and itself. When the connector 110 and its partner connector are fitted with each other, the hood portion of the partner connector similar to the hood portion 123 of the connector housing 113 is inserted into between the hood portion 126 and the two or more terminal storage rooms 123. A ring-shaped seal member 117 is fitted with the two or more terminal storage rooms 123. This seal member 117 can be closely contacted with the outer peripheral wall surfaces of the two or more terminal storage rooms 123 and the inner peripheral wall surfaces of the hood portion of the partner connector to thereby provide a waterproof condition between them.

Also, on the leading end portions of the two or more terminal storage rooms 123, there is mounted a front holder 115. A portion of the front holder 118 (the front side projecting portion of the front holder) is inserted into a flexural space of an elastic securing piece 125 to thereby secure the terminals 112 doubly.

The seal means 114 is composed of two or more (in the present embodiment, two) rectangular-shaped seal members 116 and, in each seal member 116, there are formed insertion holes 128 arranged in two stages, while each insertion hole 128 has a section shape slightly larger than the section shape of the FFC 111. While inserting the FFCs 11 into the insertion holes 128, the respective seal members 116 are positioned in the interior of the guide hole 124 of the connector housing 113 while they are arranged in the longitudinal direction of the FFC 111. And, on the peripheral wall of the connector housing 113 that defines the guide hole 124 of the connector housing 113, there is provided a contact portion 136 which can be contacted in the longitudinal direction of the FFC 111 with the peripheral edge portion of the seal member 116 that is positioned in the deepest portion of the guide hole 124.

As shown in FIG. 10, on the peripheral surface of the seal member 116 that defines the respective insertion holes 128, there is provided a ring-shaped lip 129. Inside the ring-shaped lip 129, there is set in the thickness and width directions of the FFC 111 a clearance which is smaller than the thickness and width of the FFC 11, whereby the ring-shaped lip 129 can be closely contacted with the outer peripheral surface of the FFC 111 inserted into the insertion hole 128.

The seal member 116 is formed by injection molding synthetic resin material having high elasticity and high stickability. As such material, there may be used silicone rubber, NBR (acrylonitrie butadiene rubber) and the like.

As shown in FIG. 11, in an injection molding mode 130 for molding the seal member 116, there are provided ring-shaped cavities 131 each having a triangular section shape, while each cavity 131 is used to form the ring-shaped lip 129 when molten injection molding material is filled into the mold 130. And, the mold 130 is divided into a set of mold pieces 130*a*, 130*b* by a plane L which passes through the peak portions of the ring-shaped cavities 131 having a triangular section shape. Therefore, in both of the mold pieces 130*a*, 130*b*, no constricted portion can occur, so that the strength of the mold pieces 130*a*, 130*b* can be secured sufficiently.

Also, on the outer peripheral surface of the seal member 116, there are projectingly provided two ring-shaped lips 132. These ring-shaped lips 132 are formed in such a manner that, while the seal member 116 is positioned within the guide hole 124 of the connector housing 113, the lip 132 can be closely contacted with the peripheral wall surface of the connector housing 113 defining the guide hole 124.

The thus formed two or more seal members 116 are connected to each other, for example, by an adhesive agent or due to their own high stickability into a unified body in such a manner that the insertion holes 128 arranged in two stages are allowed to continue with each other.

The rear cover 115 includes a base plate portion 133 which is formed larger than the section shape of the base end portion 13*a* of the connector housing 113, and the rear cover 115 is mounted onto the base end portion 113*a* of the connector housing 113 in such a manner that the base plate portion 133 covers the guide hole 124 of the connector housing 113. On the base plate portion 133, there is projectingly provided a pressure portion 34 which can be inserted into the guide hole 124 while the rear cover 115 is mounted on the connector housing 113.

Continuously with the base plate portion 133 and pressure portion 134 of the rear cover 115, there are formed insertion holes 127 in such a manner that they are arranged in two stages, while each insertion hole 127 is formed to have a section shape slightly larger than the section shape of the FFC 111. The rear cover 115 is mounted onto the base end portion 113*a* of the connector housing 113 while the two FFCs 111 extended from the guide hole 124 of the connector housing 113 are respectively being inserted into the insertion holes 127.

The two or more seal members 116 (that is, the seal means 114), which have been connected together into a unified body, are connected to the end face of the pressure portion 134 in such a manner that the insertion holes 128 are, in the one-side end faces of the insertion holes 128 where the insertion holes 128 are opened, connected to the insertion holes 127 which are opened on the end face of the pressure portion 134.

Further, the rear cover 115 includes a peripheral wall 135 provided upright from the peripheral edge portion of the base plate portion 133 in such a manner that the peripheral wall 135 surrounds the outer periphery of the seal means 114 with such a clearance as can store the base end portion 11 3*a* of the connector housing 113 between the peripheral wall 135 and the outer peripheral surface of the seal means 114 connected to the pressure portion 134.

Now, description will be given below of how to assemble the connector 110 structured in the above-mentioned manner.

Firstly, the FFCs 111 are inserted into the insertion holes 128, 127 of the seal means 114 and rear cover 115 which have been connected to each other. Next, the two or more terminals 112 are connected to the terminal portions of the FFCs 111. Then, while the caulked blade 121 portions of the two or more terminals 112 are gripped integrally by a proper jig, the terminals 112 are inserted and stored through the guide hole 124 of the connector housing 113 into the two or more terminal storage rooms 123 respectively. After then, the mutually connected seal means 114 and rear cover 115 are moved along the FFCs 111 toward the base end portion 113*a* of the connector housing 113; and, the seal means 114 and next the pressure portion 134 of the rear cover 115 are inserted into the guide hole 124 of the connector housing 113 respectively.

After the rear cover 115 is mounted onto the connector housing 113, the seal means 114, specifically, the other end face of the seal means 114 different from one end face where the seal means 114 is connected with the pressure portion 134 of the rear cover 115, is contacted with the contact portion 136 formed within the guide hole 124 of the connector housing 113; and, the seal means 114 is then held and compressed by and between the contact portion 136 and the pressure portion 134 of the rear cover 115.

As has been described heretofore, according to the waterproof connector for a flat cable 110, since only one lip 129 is formed in each insertion hole 128 of each seal member 116 into which the FFC 111 is inserted, no constricted portion is produced in the mold pieces 130*a*, 130*b* which cooperate together in constituting the injection molding mold 130, thereby being able to prevent the strength of the mold pieces 130*a*, 130*b* from being lowered, Thanks to this, the seal members 116 are excellent in the productivity thereof and thus the connector 110 is excellent in the productivity thereof.

And, by constructing the seal means 114 in such a manner that these seal members 116 are arranged two or more in number in the longitudinal direction of the FFCs 111, the two or more lips 129 can be closely contacted with the outer peripheral surfaces of the FFCs 111 while they are present adjacent to each other in the longitudinal direction of the FFCs 111. Thanks to this, an excellent waterproof condition can be provided between the seal means 114 and FFCs 111.

Also, according to the waterproof connector for a flat cable 110, the seal means 114 is held and compressed by and between the contact portion 136 of the connector housing 113 and the pressure portion 134 of the rear cover 115 in the longitudinal direction of the FFCs 111. Owing to this, the two or more seal means 116 cooperating together in constituting the seal means 114 are expanded in a direction intersecting at right angles with the longitudinal direction of the FFCs 111 and are thereby more closely contacted with the peripheral wall surface of the connector housing 113 defining the guide hole 124 thereof. This can enhance further the waterproof performance of the seal means 114 with respect to the FFCs 111 and connector housing 113.

Further, according to the waterproof connector for a flat cable 110, the two or more seal members 116 are connected together into a unified body, and the seal means 114 composed of the thus unified seal members 116 is then connected to the rear cover 115 into an integral body. Thanks to this, the rear cover 115 and seal means 114 can be assembled to the connector housing 113 at a time. Therefore, the connector 110 is excellent in the productivity thereof.

And, by removing the rear cover 115, the seal means 114 inserted into the guide hole 124 of the connector housing 113 can also be removed from the connector housing 113. Thanks to this, the seal means 114 is excellent in the maintenance performance thereof.

Moreover, according to the waterproof connector for a flat cable 110, since the seal means 114 is surrounded by the peripheral wall 135 of the rear cover 115, not only there can be reduced a possibility that a foreign object can stick to the seal means 114 before it is assembled to the connector housing 113 but also the seal means 114 can be prevented against damage. Thanks to this, it is possible to use highly stickable material for the two or more seal members 116 which cooperate together in forming the seal means 114, which in turn makes it possible to enhance the degree of the close contact of the seal members 116 with the FFCs 111 and connector housing 113. Therefore, the waterproof performance between the seal means 114, FFCs 111 and connector housing 113 can be enhanced further.

By the way, the present invention is not limited to the above-mentioned embodiment but other various changes, modifications and the like are also possible according to cases. Also, the materials, shapes, dimensions, numeric values, types, number, arranging positions and the like of the respective components of the above-mentioned embodiment are not limitative but can be selected arbitrarily, provided that they are capable of achieving the object of the invention.

By the way, the invention is not limited to the above-mentioned embodiments but other various changes and improvements are also possible. Also, the materials, shapes, dimensions, numerals, types, number, arrangement positions and the like of the respective composing elements of the above-mentioned embodiments are not limitative but can be selected arbitrarily, provided that they can attain the present invention.

What is claimed is:

1. A waterproof connector for a flat cable, comprising:

a connector housing, guiding therein a terminal portion of the flat cable through a guide hole formed in a base end portion thereof and storing therein a terminal connected to the terminal portion of the flat cable;

a seal member, interposed between the flat cable and a peripheral wall of the connector housing for defining the guide hole;

a rear cover, including an insertion hole for insertion of the flat cable extended out from the guide hole of the connector housing and mounted onto the base end portion of the connector housing with the flat cable inserted into the insertion hole; and a fixing plate, mounted onto the rear cover so as to hold the flat cable inserted through the insertion hole of the rear cover by and between the rear cover and the fixing plate.

2. The waterproof connector for a flat cable as set forth in claim 1, wherein the rear cover includes:

a vertical groove, extending from a middle portion of the insertion hole in the thickness direction of the flat cable to be inserted into the insertion hole; and a communication hole, extending in the width direction of the flat cable for allowing the insertion hole and the vertical groove to communicate with the outside; and wherein the fixing plate includes an insertion piece insertable from the communication hole and fittable with the vertical groove with the flat cable interposed between a wall surface defining the vertical groove and itself.

3. The waterproof connector for a flat cable as set forth in claim 1, wherein a step portion is recessedly formed in an opening portion of the insertion hole of the rear cover so as to widen the opening of the insertion hole of the flat cable to be inserted, and the fixing plate includes a fitting portion fittable with the step portion with the flat cable interposed between the step portion and itself.

4. The waterproof connector for a flat cable as set forth in claim 3, wherein a transverse groove extending in the opposite direction to the extending direction of the flat cable extended from the insertion hole, is recessedly formed in the step portion of the insertion hole of the rear cover, and, in the fitting portion of the fixing plate, there is provided a projection fittable with the transverse groove with the flat cable interposed between a wall surface defining the transverse groove and itself.

* * * * *